United States Patent [19]

Patton et al.

[11] 4,157,729

[45] Jun. 12, 1979

[54] APPARATUS AND METHOD FOR PRODUCING FILAMENTS

[75] Inventors: Robert J. Patton, Westford; Thomas J. Sentementes, Wakefield, both of Mass.

[73] Assignee: GTE Sylvania Incorporated, Stamford, Conn.

[21] Appl. No.: 853,095

[22] Filed: Nov. 21, 1977

[51] Int. Cl.[2] ..... B22D 11/06; B22D 11/10

[52] U.S. Cl. ..... 164/87; 164/50; 164/250; 164/423

[58] Field of Search ..... 164/50, 51, 87, 250, 164/251, 423, 48, 49, 147

[56] References Cited

U.S. PATENT DOCUMENTS

| | | | |
|---|---|---|---|
| 2,866,700 | 12/1958 | Bohnet et al. | 164/51 X |
| 3,896,203 | 7/1975 | Maringer et al. | 164/87 X |

*Primary Examiner*—Robert D. Baldwin

*Attorney, Agent, or Firm*—Lawrence R. Fraley

[57] ABSTRACT

There is described an improved apparatus for producing filaments from a high melting point material by forming a pendant drop at the end of the material and engaging the drop with a rotating heat extracting member (e.g. copper disc). The improvement to the apparatus comprises a pair of heating components to heat the material to a temperature immediately below its melting point and thereafter heat only the end of the material to the melting point. The result is a vibration free pendant drop suspended from the rod's end. A method for making the filament is also described.

12 Claims, 2 Drawing Figures

APPARATUS AND METHOD FOR PRODUCING FILAMENTS

BACKGROUND OF THE INVENTION

The invention relates to the making of filaments and particularly to filament production wherein an elongated rod has a pendant drop formed thereon which is engaged by a rotating heat extracting member such as a copper disc.

Even more particularly, the invention relates to the above subject matter wherein filaments are produced from rods of high melting point material, e.g. those having melting points exceeding 1300° Celsius.

With regard to the present invention, the term filament is meant to define slender, elongated metallic elements each having a transverse dimension less than the element's length dimension. Examples of such element's may include sheet, ribbon, or wire. One particular use for these products is as the combustible fill material within a photoflash lamp such as described in U.S. Pat. Nos. 3,535,063 (L. F. Anderson et al), 3,897,196 (J. P. Saunders et al), and 4,008,040 (D. E. Murray et al), all of which are assigned to the assignee of the present invention. The combustible fill material readily ignites upon activation to provide the intense flash typically associated with photoflash applications. At least two methods are presently used to produce elongated filaments from rods of metallic material. The first involves forming a suspended or pendant drop on the end of a vertically oriented rod and engaging the drop from below with a rotating copper disc. Such a process is described in U.S. Pat. No. 3,896,203 (Maringer et al). The disc has a chill surface which has a coefficient of thermal conductivity sufficient to withdraw heat from the molten drop in such rapid fashion so as to form the filamentary element on the surface of the disc. The filament is thereafter emitted and collected for future use.

A second method of producing metallic filaments from rods involves formation of what is termed a sessile drop. By sessile is meant a drop which is substantially upwardly projected using suitable means to engage a rotating casting disc located above the drop. In other words, the rod and disc are inverted in comparison to the arrangement described in the aforementioned suspended drop process. With regard to the present invention, the term pendant drop will be used and is meant to include both suspended and sessile drops.

Because of the requirement for either a vacuum or protective gas atmosphere when producing high melting point material filaments, a preferred means for melting the rod is induction heating. Unfortunately, the power requirements for providing the energy necessary to melt such materials are so high and vibrations arising from magnetic stirring and related electrical effects are usually established in the molten drop. These vibrations in turn result in the production of dimensionally inconsistent filaments due to variations in the dwell time of the filaments on the casting disc. The dwell time is defined as the period during which the formed filament resides on (adheres to) the disc's chill surface.

From the foregoing background, it can be readily understood that an apparatus and method which are capable of producing dimensionally consistent filaments from elongated rods of high melting point material by eliminating vibrations in the molten drop from which the filaments are emitted would constitute a significant advancement in the art.

OBJECTS AND SUMMARY OF THE INVENTION

It is therefore a primary object of the instant invention to enhance the manufacture of high melting point material filaments by providing an apparatus and method capable of producing said filaments without creating vibrations in the molten parent material.

In accordance with one embodiment of the invention, an improved filament producing apparatus is defined wherein the improvement resides in the apparatus's means for liquefying (or melting) the end of the rod to produce the desired pendant drop. At least two heating means are employed wherein the first heats the rod's end and an adjoining region to just below the material's melting point. Thereafter, a second heating means heats only the end to provide the pendant drop thereon. As stated earlier, this pendant drop is substantially vibration-free.

According to another aspect of the invention, an improved method is defined for producing vibration-free pendant drops on the end of a rod of high melting point material. The method includes heating the end of the rod and an adjoining region to a temperature below the melting point, and thereafter heating the rod's end to the melting temperature.

In the above method and apparatus, a rotating heat extracting member is used to engage the drop and effect release of the filament therefrom.

DETAILED DESCRIPTION OF THE PREFERRED EMBODIMENTS

For a better understanding of the present invention together with other and further objects, advantages and capabilities thereof, reference is made to the following disclosure and appended claims in connection with the above described drawings.

Figure 1:
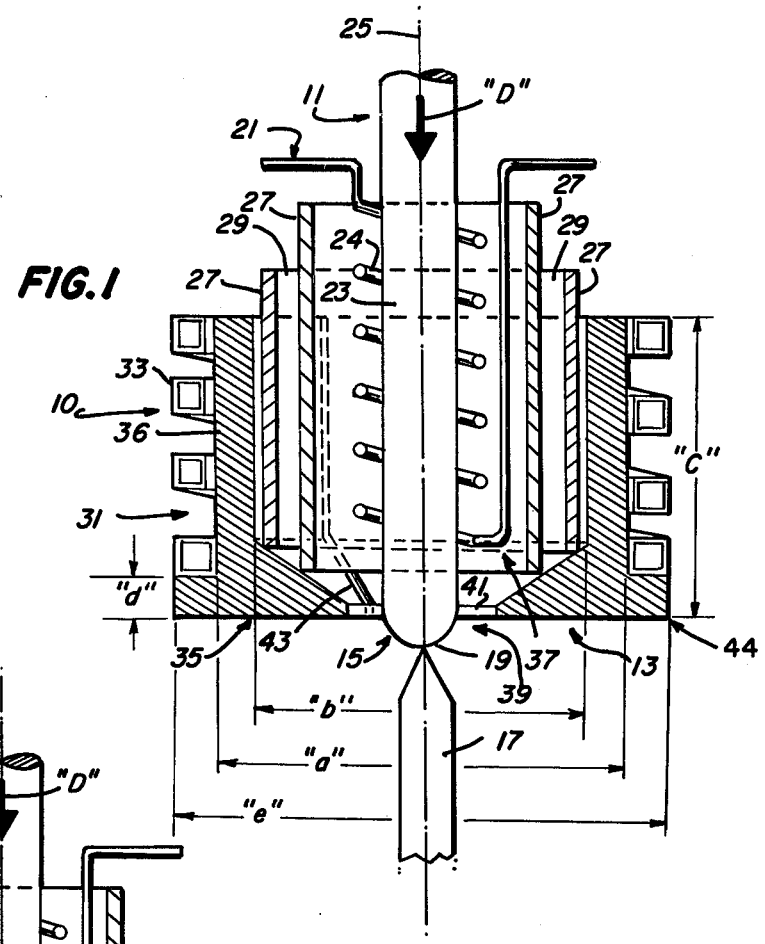
FIG. 1 is a side elevational view, in section, of a filament producing apparatus in accordance with one embodiment of the invention.

With particular reference to FIG. 1, there is shown an apparatus 10 for producing filaments from a rod 11 of high melting point metallic material. The preferred material for use in the invention is zirconium which has a melting point of about 1850° Celsius. By high melting point materials are meant those having a melting point above about 1300° Celsius. Other examples of materials capable of being used include titanium, vanadium and iron.

Apparatus 10 includes means 13 for liquefying the end 15 of rod 11 and a rotating heat extracting member 17 (e.g. copper disc) which engages the resulting molten drop 19 formed on end 15. Previously known liquefying means usually comprised a relatively high powered induction coil which was necessary to successfully heat the material to the melting temperatures. The present invention eliminates this requirement and the resulting adverse effects as previously described by providing an improved means 13 which comprises a first heating means 21 for heating end 15 and a region 23 adjoining this end to a temperature immediately below the melting point of rod 11.

First heating means 21 preferably comprises a tungsten resistance coil 24 coaxially positioned about rod 11 in the vicinity of region 23. In FIG. 1, rod 11 is fed through apparatus 10 along a direction "D" which lies on the axis 25 of the rod. Electrical current is supplied coil 24 and the coil heated. Accordingly, it is understood that the first heating means of the invention utilizes thermal radiation to heat the end 15 and adjoining region 23 of rod 11 to the described temperature and does not use high frequency induction. To assist in retaining the heat generated by coil 24 is the area immediately about end 15 and region 23 and thereby assure that these locations will remain heated to the desired temperatures, at least one heat shielding member 27 is employed. Member 27 is preferably cylindrical and comprised of alumina ($Al_2O_3$). Other suitable electrically insulative materials include magnesia, beryllia and boron nitride.

It is preferred in the present invention to utilize from two to four members 27 (two shown in FIGS. 1 and 3) and to space these components apart in the manner indicated. Each is coaxially oriented about rod 11 and an insulating space 29 is provided therebetween. In accordance with another embodiment of the invention, three such members 27 were used with two insulative spaces 29 provided.

First heater 21 heats the zirconium rod 11 to a temperature within the range of about 1750° to about 1825° Celsius, depending on the location within the apparatus where the temperature is taken.

The zirconium rod preferably has a diameter of about 0.250 inch. Accordingly, the length of region 23 is about 2.0 inches. Rod 11 is fed through apparatus 10 at a rate of about 0.5 inch per minute while rotating disc 17 revolves at a rate of from 500 to 2000 revolutions per minute. Disc 17 preferably has a diameter of about 8.0 inches and is comprised of copper. Casting discs or wheels suitable for use in the invention are well known in the art and further description is not believed necessary. Filaments produced from the invention, including both the embodiments depicted in FIGS. 1 and 2, have a typical length of about 10.0 inches and a cross-sectional area within the range of about $1.5\times10^{-6}$ to $2.1\times10^{-5}$ square inches.

Because high melting point materials are used which are highly susceptible to oxidation, apparatus 10 is surrounded by either a vacuum or protective gas atmosphere. An example of such an atmosphere is one wherein the gases argon, helium or, in some cases, nitrogen are present.

Liquifying means 13 further comprises a second heating means 31, the function of which is to heat only the end 15 of rod 11 to the rod's melting point. It is to be remembered that end 15 are adjoining region 23 are already at the aforedescribed first temperature immediately below the melting point. Means 31 preferably comprises an RF induction coil 33 and concentrator 35 combination wherein coil 33 induces a current flow in the concentrator. Concentrator 35 includes a substantially cylindrical conductive housing 36 which defines a chamber 37 therein and a narrow annular opening 39 at one end of the chamber. Rod 11 is located within apparatus 10 such that the pendant drop formed on end 19 is oriented within opening 39. Concentrator 35, because of its geometry, causes a relatively large current flow along an edge 41 of opening 39 which in turn induces a large electrical current into the drop to heat it to the melting point. Concentrator 35 includes a slot 43 therethrough to assure the aforedescribed current flow. As stated, housing 36 is substantially cylindrical having an outside diameter of 2.125 inches (dimension "a"), a corresponding inner diameter of 1.375 inches (dimension "b"), and a height of 1.625 inches (dimension "c"). The housing also includes a stepped region 44 which has a height of 0.375 inch (dimension "d") and an outer diameter of 2.375 inches (dimension "e"). The preferred material for concentrator 35 is copper.

Figure 2:
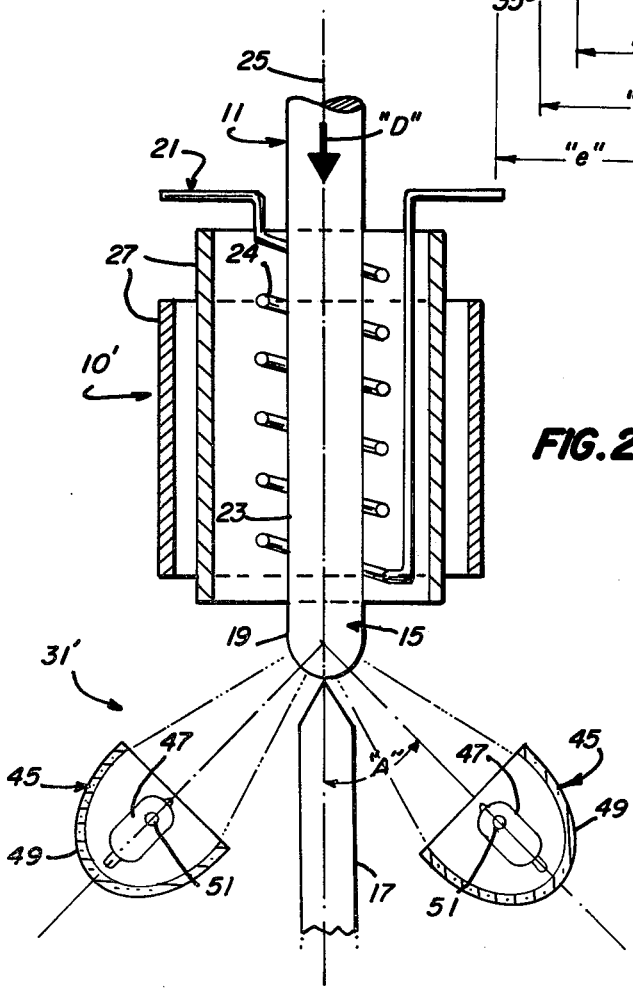
FIG. 2 is a side elevational view, in section, of a filament producing apparatus according to another embodiment of the invention.

In FIG. 2, apparatus 10 is shown as including the above tungsten coil 24 as the first heating means 21 in addition to the shielding members 27 thereabout. In this embodiment, members 27 are preferably tungsten and/or molybdenum. Rod 11 is shown as advancing in direction "D" toward heat-extracting disc 17. In the embodiment of FIG. 2, second heating means 31' comprises a plurality of individual high intensity lighting units 45 which each concentrate their radiant heat toward end 15 of rod 11. Understandably, utilization of units 45 eliminates any possibility of drop vibration as a result of RF energy absorption by the drop. Vibration from RF energy absorption was substantially eliminated in FIG. 1 by supplying the rod's end and an adjoining region with a large portion of the energy required to reduce the rod to a molten state. As a result, the Rf energy supplied by the induction coil and concentrator was minimal and did not adversely affect the drop's stability.

Although only two are shown for descriptive purposes, the preferred number of lighting units 45 is four with each comprising an incandescent lamp 47 positioned within an ellipsoidal reflector 49. Examples of lamps 47 suitable for use in the invention include those of the tungsten-halogen variety (e.g. 350 watt, 30 volts, 3400° K.). Tungsten-halogen lamps are well known in the incandescent lamp art with several types manufactured by the assignee of the invention. The preferred ellipsoidal reflectors 49 for use with the invention are available from the Melles Griot Company, Danbury, Connecticut, under model number 02REM005. Each of the four units 45 is preferably located at an angle "A" with the axis 25 of rod 11. (Disc 17 also lies on axis 25 similar to the embodiment of FIG. 1). Angle "A" is preferably within the range of about 45 to 90 degrees. Given the above parameters for rod 11 (e.g. diameter, rate of travel, etc.), the radiation from each lamp is focused on drop 19 such that a solid angle of about 1.1 steradians is subtended at the respective reflector.

Lighting units 45 are capable of supplying the remaining energy to end 15 necessary to provide molten drop 19 thereon. As in the case of heater 21 in FIG. 1, the first heater in FIG. 2 has provided sufficient heat to assure that end 15 and adjoining region 23 are at the required first temperatures. The described second heating means of the invention, either the induction coil and concentrator combination which induces current flow only in a localized portion (end 15) of rod 11 or the plurality of lighting units which concentrate radiant heat also at said end, thereby operates in a different manner than the first heating means of the invention which, as described, is a resistance heater and which heats a significantly larger area of rod 11.

Thus there has been shown and described an improved apparatus for producing metallic filaments from rods of high melting point material. The invention as defined assures provision of a substantially vibration-free pendant drop at the end of each rod to permit facile removal of the desired filaments therefrom.

While there have been shown and described what are at present considered the preferred embodiments of the invention it will be obvious to those skilled in the art that various changes and modifications may be made therein without departing from the scope of the invention as defined by the appended claims.

We claim:

1. In an apparatus for producing filaments from a rod of high melting point material wherein said apparatus includes means for liquefying said rod to provide a pendant drop at one end thereof and a rotating heat extracting member for engaging said pendant drop, the improvement wherein said means for liquefying said rod comprises:

first heating means for heating both said end of said rod and a region adjoining said end by thermal radiation to a first temperature immediately below the melting point of said material, said first heating means substantially non-inductive; and second heating means spacedly positioned from said first heating means for heating only said end of said rod to the melting point of said material to provide a substantially vibration-free pendant drop thereon.

2. The improvement according to claim 1 wherein said first heating means comprises a resistance coil coaxially positioned about said rod.

3. The improvement according to claim 2 wherein said coil is tungsten.

4. The improvement according to claim 2 further including at least one heat shielding member located about said resistance coil.

5. The improvement according to claim 4 wherein the number of heat shielding members is two, each of said members spacedly positioned from the other and coaxially oriented about said rod.

6. The improvement according to claim 1 wherein said second heating means comprises an induction coil and concentrator, said concentrator defining a chamber therein and including a narrow opening at one end thereof and positioned substantially about said end of said rod.

7. The improvement according to claim 1 wherein said second heating means comprises a plurality of individual lighting units each including a reflector and an incandescent lamp therein, said lighting units substantially concentrating the radiant heat therefrom on said end of said rod.

8. The improvement according to claim 7 wherein the number of lighting units is four, each of said incandescent lamps of the tungsten-halogen variety.

9. The improvement according to claim 1 wherein said second heating means operates in a different manner than said first heating means.

10. In a method for producing filaments from a rod of high melting point material wherein said method includes liquefying said rod to provide a pendant drop at one end thereof and engaging said pendant drop with a rotating heat extracting member, the improvement comprising:

heating both said end of said rod and a region adjoining said end by thermal radiation to a first temperature using a first, substantially non-inductive heating means, said first temperature immediately below the melting point of said material; and thereafter heating only said heated end of said rod to the melting point temperature of said material using a second heating means spacedly positioned from said first heating means to provide a substantially vibration-free pendant drop on said end.

11. The method according to claim 10 wherein said high melting point material is zirconium.

12. The method according to claim 11 wherein said first temperature in within the range of about 1750 to about 1825 degrees Celsius.

* * * * *